United States Patent [19]

Korshunov

[11] 4,044,584

[45] Aug. 30, 1977

[54] MILL FOR ROLLING CONTINUOUSLY CAST INGOT

[76] Inventor: Evgeny Alexeevich Korshunov, pereulok Otdelny, 5a, kv. 29, Sverdlovsk, U.S.S.R.

[21] Appl. No.: 730,649

[22] Filed: Oct. 7, 1976

[30] Foreign Application Priority Data

Oct. 15, 1976 U.S.S.R. ..... 2177703

[51] Int. Cl.[2] ..... B21B 13/22

[52] U.S. Cl. ..... 72/214

[58] Field of Search ..... 72/214, 208, 209, 193

[56] References Cited

U.S. PATENT DOCUMENTS

| | | | |
|---|---|---|---|
| 3,821,889 | 7/1974 | Sahsagansky et al. | 72/249 |
| 3,982,416 | 9/1976 | Pozsgay | 72/214 |

*Primary Examiner*—Milton S. Mehr

*Attorney, Agent, or Firm*—Lackenbach, Lilling & Siegel

[57] ABSTRACT

A rolling mill comprises a movable mill stand mounted in slideways and accommodating a mill roll unit installed therein on supports, said mill roll unit including housings with grooved mill rolls disposed therein and roll necks which are coupled with hydraulic drives and gear wheels in mesh with each other. The movable mill stand is equipped with two linear cylindrical inductors establishing a travelling magnetic field. Said inductors are mounted on supports coincident with the axis of rolling of a round ingot, referred to hereinafter as a continuous round casting, and are rotatable about said axis of rolling through an angle of at least 90°, the mill roll unit being disposed intermediate of said inductors and being fixed rigidly to the end faces of the inductor bodies.

1 Claim, 4 Drawing Figures

MILL FOR ROLLING CONTINUOUSLY CAST INGOT

The present invention relates to metallurgy, and more particularly to mills for rolling a continuously cast round ingot, referred to hereinafter as a continuous round casting, said mills being mainly adaptable for cogging the casting whose motion alternates with standstills.

Known in the art are rolling mills adapted for direct rolling of a continuous casting.

These mills include multiple-stand continuous mills, as well as pendulum and planetary mills.

Said mills for direct rolling of a continuous casting are widely used when the casting is continuously withdrawn from a mould.

However, where a need arises for rolling a continuous casting whose motion alternates with standstills, the use of said mills becomes practically inexpedient, the power requirements of said mills increase considerably in that case and their utilization factor becomes rather small, ranging only within 10–30%.

In this case adopted as a prototype is a rolling mill adapted mainly for rolling a continuous casting whose travel alternates with standstills. Patents for that mill are pending in Great Britain Pat. No. 55740, Feb. 30, 1974; Canada Pat. No. 186549, Nov. 23, 1973; and the U.S. Pat. No. 422071 (for a method, Dec. 12, 1973 (the mill being disclosed in a divisional application whose number is yet unknown).

Said mill comprises slideways which are mounted on a foundation and along which travels a movable mill stand provided with a bottom- and a top-mill separators and two housings each having two braces between which are installed roll chocks with bearings wherein are mounted grooved mill rolls with their necks. Said roll necks carry gear wheels in mesh with toothed racks whose ends are coupled with connecting rods of hydraulic cylinders fixed on the housing braces. Apart from a hydraulic drive for rotating mill rolls the mill is furnished with another drive ensuring reciprocation of said movable mill stand.

As the continuous casting is being rolled on said rolling mill, the movable mill stand reciprocates, being displaced towards a casting unrolled portion after each working stroke until the sum of said displacements is equal to the length of said casting extracted from a mould within a withdrawal period. Next the movable mill stand is caused to travel towards a casting rolled portion over a distance amounting to said sum of the stand displacements, the rolling process being continued after the next portion of the casting has been withdrawn from the mould.

Said rolling mill provides efficient rolling of a continuous casting whose motion alternates with standstills by applying relatively small roll forces, this limiting to a certain extent the mill production rate. When the mill drive rating and hence the roll force are enhanced, a higher mill production rate will result, but the arrangement of said more powerful drive on the housing braces of the mill movable stand poses a problem.

The main object of the invention is the provision of a mill for rolling a continuously cast ingot, referred to hereinafter as a continuous casting, which would allow relief of a main mill roll drive.

Another object of the invention is the provision of a mill for rolling a continuous casting which would make it possible to effect an idle transfer of a movable mill stand along slideways.

Still another object of the invention is to provide a mill for rolling a continuous casting which would enable successive reduction of a round casting in two directions mutually perpendicular to one another between one pair of mill rolls.

Yet another object of the invention is the provision of a mill for rolling a continuous casting which would permit the heating of a rolled casting.

Said and other objects of the invention are achieved in a mill for rolling a continuous casting, said mill being mainly adaptable for cogging the casting whose motion alternates with standstills and comprising a movable mill stand mounted in slideways running coincident with the axis of rolling, said mill stand including a stage-separator and a top-mill separator, said separators interconnecting two pairs of braces between which are installed mill roll unit supports, said mill roll unit comprising housings accommodating a pair of grooved rolls whose necks protrude outward of said housings, a pair of said necks arranged on the side of one housing being coupled with hydraulic drives fixed on said housing, and another pair of the necks disposed on the side of another housing being connected to gear wheels in mesh with each other.

According to the invention, the movable mill stand is equipped with two linear cylindrical inductors establishing a travelling magnetic field, said inductors being mounted on movable mill stand supports along the axis of rolling of the round casting and being rotatable about said axis of rolling through an angle of at least 90°, whereas the mill roll unit being disposed intermediate of said inductors and being rigidly fixed through the housings to end faces of inductor bodies.

Essentially, the present invention aims to provide a mill for rolling a round continuous casting, said mill being furnished with a mill roll drive featuring a small rating, as compared with the prior-art mills of a similar application; it ensures a requisite heating of the casting concurrently with its rolling, which makes it possible to obviate the use of special purpose heating devices, and to strike them off the list of the caster process equipment it enables successive reduction of said round casting in two directions mutually perpendicular to one another, a feature which allows using only one (instead of two) mill stand for rolling a continuous round casting which cannot be turned about its axis. This drastically cuts down both the overall expences and the mill operating cost.

The present invention will be better understood from a consideration of a detailed description of an exemplary embodiment thereof, to be had in conjunction with the accompanying drawings, in which.

Figure 1:
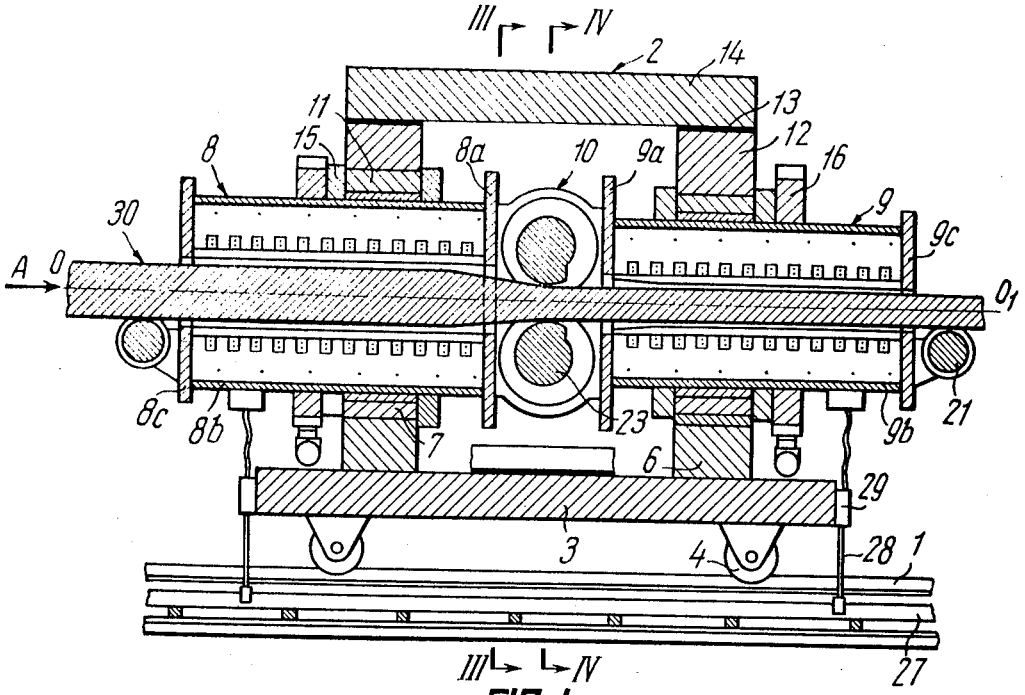
FIG. 1 is a cross sectional view taken along the axis of rolling, partially broken away, of a mill for rolling a continuous casting, according to the invention.
Figure 2:
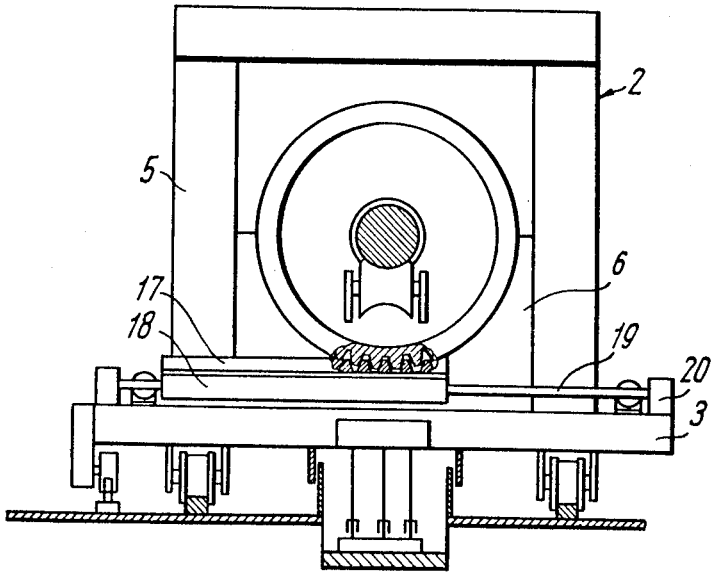
FIG. 2 is a view taken in the direction of arrow A in FIG. 1.

With reference to FIGS. 1 and 2 a rolling mill embodying the features of the invention comprises slideways 1 in which is mounted a movable mill stand 2.

Said movable mill stand has a stage-separator 3 fitted with runners 4 through which the weight of said movable stand is transmitted to the slidways 1.

The stage-separator 3 mounts two pairs of braces 5 (FIG. 2). Disposed intermediate of each brace pair and coincident with the axis of rolling 0—0$_1$ are supports 6 with insertion pieces 7 (FIG. 1), said supports 6 mounting a unit, comprising inductors 8 and 9 fastened to each other, and a mill roll unit 10. A top-mill separator 14 secured to the braces 5 presses cylindrical parts 8*b* and 9*b* of the bodies of the inductors 8 and 9 through top insertion pieces 11, covers 12 and gaskets 13 to the supports 6.

Fixed on each cylindrical part 8*b* and 9*b* of the bodies of the inductors 8 and 9 are a pair of flanges 15, which precludes axial displacement of the inductors with respect to the supports and stand braces, and a single gear wheel 16.

The flanges 15 comprises in each pair mounted on each inductor are spaced at a distance corresponding to a lengthwise size of the appropriate support with its insertion piece, whereas the spacing between the flange pairs arranged on the inductors 8 and 9 corresponds to the distance between two inductor supports 6.

The gear wheels 16 are in mesh with toothed racks 17 set up on movable hydraulic cylinders 18 mounted movably with respect to a rod 19 with a piston fixed stationary in brackets 20. The brackets are secured on said stage-separator 3.

At the entrance and exit of the rolled casting in the movable mill stand, and faces 8*c* and 9*c* of the inductor bodies are fitted with guide rollers 21.

Figure 3:
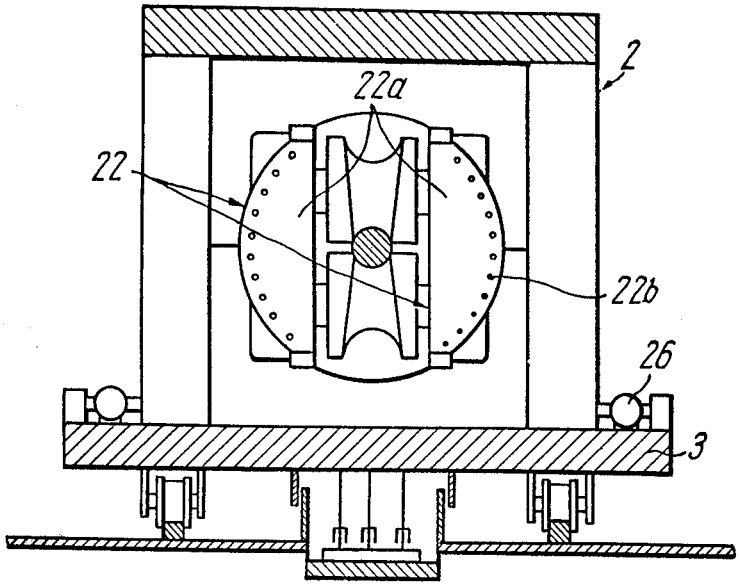
FIG. 3 is a cross sectional view taken along the line III—III in FIG. 1.
Figure 4:
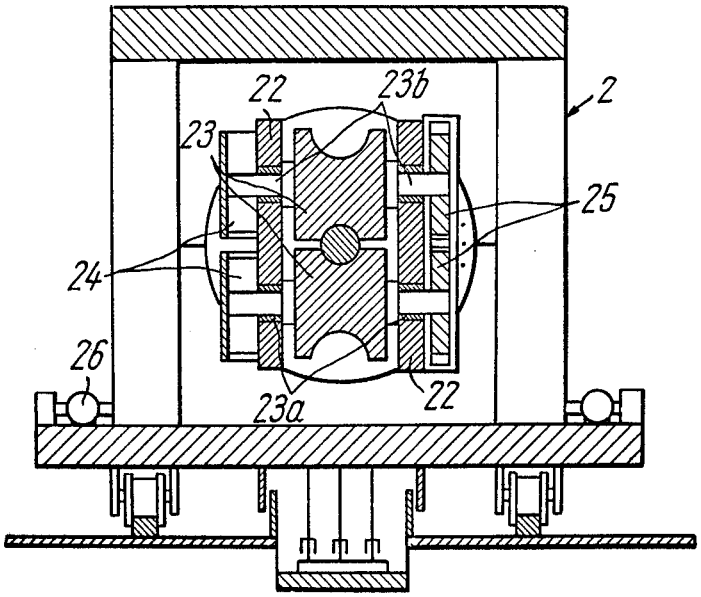
FIG. 4 is a cross sectional view taken along the line IV—IV of FIG. 1.

The mill roll unit 10 comprises two cast housings 22 (FIGS. 3 and 4) with flanges 22*a* shaped as segments with a radius approximating that of round conjugated end face walls of said inductors 8 and 9. The housings 22 have drillings (openings) to receive bearings 23*a* of the grooved mill rolls 23. Necks 23*b* of said mill rolls are extended, one pair of said necks on the side of one housing 22 being coupled with hydraulic drives 24 of the mill rolls 23, while another neck pair arranged on, the side of another housing interacts with gear wheels 25 in mesh with each other. The bodies of said hydraulic drives are secured on the housing 22.

The flanges 22*a* of the housings 22 and the end faces 8*a* and 9*a* of the bodies of said inductors 8 and 9 have coaxial openings 22*b* adapted to receive fasteners interconnecting the inductors 8 and 9 and the mill roll unit 10 into a single rigid assembly.

As to supplying working fluid to the hydraulic engines and coolant to the inductors, these are fed along flexible hoses (not shown in the drawings) running from manifolds 26 laid on the stage-separator 3.

The inductors are powered from busbars 27 through current collectors 28 and distribution boxes 29. (The current collectors and busbars are shown in FIGS. 1 through 4 disgrammatically, their structure being dependent on the mill operating conditions).

Under steady-state operating conditions the hereinproposed mill for rolling a continuous round casting whose motion alternates with standstills operates in the following manner.

After a withdrawal period, when a casting 30 has been extracted from a mould (not shown in the drawing), the movable mill stand 2 is brought into a position corresponding to the assigned reduction of the casting during the next working stroke. Said operation, i.e. an appropriate setting of the movable mill stand, is accomplished (with the grooved mill rolls 23 brought out of contact with the rolled casting) due to a pulling or pushing force created owing to a reaction of the electromagnetic forces induced in the rolled casting by means of the inductors 8 and 9. Next the hydraulic drive 24 of the mill rolls 23 is actuated and gives them a slight idle turn through a small angle, whereafter the mill rolls grip a rolled strip (casting). At the same time as the casting is being gripped by the mill rolls, the inductors 8 and 9 are switched over to an operating duty, providing a working transfer of said movable mill stand. The further working displacement of said movable mill stand is effected by reducing the casting between the mill rolls, the roll force being developed by both the roll hydraulic drive 24 and the pulling force established by means of the inductor 8 and the pushing force established by means of the inductor 9.

Upon reducing the casting between the mill rolls the inductor 9 is cut off from the power source, the rolls are brought out of contact with the rolled casting the after a slight idle turn they are registered rigidly in an extreme position, the mill stand being shifted by the inductor 8 towards a casting unrolled part over a distance corresponding to the casting reduction degree during the next working transfer of said movable mill stand towards the casting unrolled portion. Afterwards the mill rolls 23 upon being reversed by the hydraulic drive 24 are first given a slight idle turn, whereupon they grip the casting and commence the next reduction thereof. Simultaneously with the casting being gripped by the mill rolls, a pushing force is developed by means of the inductor 8, and a pulling force is eatablished by the inductor 9, which are applied to said movable mill stand.

Upon reciprocating motion of the movable mill stand, both the assembly of the inductors 8 and 9 and the mill roll unit 10 are turned about the axis of rolling through an angle of 90° and upon setting said movable mill stand to a corresponding position, prior to its working stroke, it (said movable mill stand) is again imparted a reciprocating motion, the casting being reduced during said motion from the side at right angles to the direction of the preceding reduction.

Said unit is then reversed by 90°, and the next reducing cycle is effected, the movable mill stand reciprocating during that cycle.

Said reciprocating cycles are carried on until a casting is rolled equal in length to its portion that is extracted from the mould over the withdrawal period. After that the movable mill stand is shifted under the effect of the pulling and pushing forces developed by means of the inductors 8 and 9 or only due to the pushing force established by the inductor 8 to its initial position towards the casting rolled portion.

The rolling process is resumed after the next portion of the casting has been withdrawn out of the mould.

During the rolling operation the casting is concurrently heated with inductive currents induced in the casting by the inductors 8 and 9. A higher casting temperature contributes to a lower casting resistance to deformation and hence to a lower roll force.

The inductors are fed with an alternating current whose frequency is dependent on particular conditions and can range from a standard (50 Hz) value to lower or higher frequencies. The preferred a.c. frequencies are 50, 40–2000 Hz.

As an alternating current is being supplied to the inductors, a travelling magnetic field is established therein, said field permeating to a certain depth the rolled casting, placed intermediate of said inductors, and establishing the electromagnetic forces therein which tend to pull the casting out of the space between said inductors. But as the casting under consideration is of the continuous type and cannot be pushed out, the inductors, and consequently the entire movable mill stand, are displaced with respect to said casting to a certain side, depending on the direction of the travelling magnetic field in the inductors.

Free transfer of said inductors together with the movable mill stand is hindered by the mill rolls. The movable mill stand is capable of being shifted in a certain direction during its working transfer, when the mill rolls are in contact with the rolled casting, but only after the rolls enclosed in said stand have reduced the casting.

In their strive for shifting relative to the casting, the inductors develop a pulling force and a pushing force acting on the stand and providing for the creaction of a certain roll force in said mill rolls. Said roll force can be sufficient to enable rolling of the casting with an assigned reduction degree. However, since the movable mill stand mounts also the mill roll drive, said roll force is produced to a certain extent on account of said drive as well.

Simultaneously with the pulling and pushing forces established under the effect of said electromagnetic forces and applied to the movable mill stand, the continuous casting is heated with the inductive currents. The rolled casting can remain in the zone of influence of said inductive currents for a period of time ranging from several dozens of seconds to several minutes. But that period is sufficient to raise substantially the temperature of said casting in the rolling zone. Thus, the casting temperature can increase by several dozens of degrees, e.g., by 50–200° C. The surface layers of said casting can melt, if necessary. In view of the heating of the continuous casting, the strength of the rolled metal decreases with the ensuring reduction in the required roll force.

The economic effect from the application of the proposed rolling mill is attained in that it makes it possible to dispense with special-purpose heating appliances for preheating castings prior to rolling.

This effect is also achieved in that a single movable stand of the proposed mill replaces the operation of a multiple stand rolling mill adapted for rolling round castings. As to the operating conditions of the herein-proposed rolling mill created during direct rolling of a continuous casting whose motion alternates with standstills, these happen to be more favorable that those in the case of said multiple-stand rolling mill, when the latter is used for rolling a continuous casting whose motion alternates with standstills.

What is claimed is:

1. A mill for rolling a round continuously cast ingot, said mill rolling the ingot intermittently, and comprising: slideways running coincident with the axis of rolling and mounted on a foundation and a movable mill stand mounted in said slideways, said mill stand comprising: a stage-separator fitted with runners and travelling along said slideways; two pairs of braces fixed on said stage-separator; a top-mill separator interconnecting said braces; two supports with insertion pieces, said supports being installed along the axis of rolling on said stage-separator and being intermediate of said braces; two cylindrical inductors set up on said supports and having bodies with cylindrical shapes and end face parts, said inductors being adapted for establishing a travelling magnetic field therein; two pairs of flanges fixed on the cylindrical portions of the bodies of said inductors, the flanges, comprised in each flange pair mounted on each of said inductors, being spaced at a distance corresponding to a lengthwise size of the appropriate supports with the insertion piece, and the spacing between the pairs of said flanges set up on said inductors corresponding to that between the inductor supports; said inductors with the flanges are rotatably mounted on the insertion pieces of said supports through an angle of at least 90° about the axis of rolling and are pressed to said insertion pieces by said top-mill separator, which precludes the displacement of said inductors relative to said supports towards the axis of rolling; and a mill roll unit disposed intermediate of the end faces of said inductor bodies and fixed rigidly to said end faces, said mill roll unit having two housings with openings, said housings being rigidly fixed on the end faces of said inductor bodies, two grooved rolls with lengthened necks introduced into the openings in said housings, two hydraulic drives mounted on one of said housings and coupled with the necks of said grooved mill rolls, and two gear wheels in mesh with each other fitted on the necks of said mill rolls from the side of the other of said housings.

* * * * *